United States Patent [19]

Smith, Jr.

[11] 4,088,203

[45] May 9, 1978

[54] ADJUSTABLE SCAFFOLD

[76] Inventor: Raymond E. Smith, Jr., 385 E. Greenwood, Lake Forest, Ill. 60045

[21] Appl. No.: 738,599

[22] Filed: Nov. 3, 1976

[51] Int. Cl.[2] ..... E04G 1/22

[52] U.S. Cl. ..... 182/141; 182/63; 52/109; 187/18; 254/122

[58] Field of Search ..... 182/141, 148, 63, 69; 254/122; 187/18; 52/109

[56] References Cited

U.S. PATENT DOCUMENTS

| | | | |
|---|---|---|---|
| 3,796,282 | 3/1974 | Denier | 182/141 |
| 3,889,778 | 6/1975 | Dotts | 182/63 |
| 3,983,960 | 10/1976 | Sikli | 187/18 |
| 3,991,857 | 11/1976 | Wolk | 254/122 |

*Primary Examiner*—Reinaldo P. Machado

[57] ABSTRACT

An adjustable scaffold having a platform supported from a base by at least two sets of scissors connectors, and a lifting means for adjusting the platform between stored and elevated positions. The lifting means is pivotally attached between, rather than within, the sets of scissors connectors.

6 Claims, 3 Drawing Figures

ADJUSTABLE SCAFFOLD

BACKGROUND OF THE INVENTION

1. Field of the Invention

This invention relates generally to the field of adjustable scaffolds comprising a platform, a base, and an adjustable interconnecting support structure. It relates specifically to an adjustable scaffold which efficiently and safely lifts heavy loads with a minimum of stress on its supporting members. The scaffold can be raised and lowered to a range of heights intermediate stored and elevated positions, and provides a stable scaffold at each of those heights.

2. Description of the Prior Art

In building construction and overhead maintenance, for example, it is often necessary to provide adjustable scaffolds or work towers for workmen and equipment. In the past most adjustable scaffolds comprised a platform, a base, and an adjustable, interconnecting structure, typically including "lazy tong" or scissors connectors. Each set of scissors connectors comprised at least a pair of crossed members of substantially the same length, pivotally connected near the center of each member. The scissors connectors were movable to elevated and stored positions by lifting devices, typically hydraulic cylinders and accompanying lever brackets, so positioned that the forces exerted by the hydraulic cylinders upon the scissors connectors are always inclined at an angle from the horizontal.

The hydraulic cylinders were typically positioned so that they operated within a set of scissors connectors, usually within the bottom set. In other words, the hydraulic cylinders typically joined crossed members from the same set of scissors connectors. This placement required that one end of the hydraulic cylinder be attached near the lower end of a member of the scissors connectors, and the other end of the cylinder be attached near the center of the other member, substantially as shown in Smith, Jr., U.S. Pat. No. 3,485,321 (issued to applicant), at FIGS. 4, 5, and 7. In the past, all the hydraulic cylinder lifting means have typically been placed on one side of the plane defined by the points comprising the central pivot points of the crossed members.

Furthermore, to ensure stability, each set of scissors connectors in the prior art had two pairs of pivotally connected crossed members, each pair being positioned at opposite sides of a rectangular platform or base. Lateral supports between the two pairs were used to form a more solid structure. These lateral supports were attached at each end of the members, and at their central pivot connections, spanning the lateral gap between the two pairs of scissors connectors. The lifting means were positioned within this lateral gap, requiring support bars for connection to the outer members.

While this positioning of the cylinders and the structure of the scissors connectors has been adequate for loads of up to approximately 1500 pounds, the lifting and rigid support of heavier loads has not been satisfactorily accomplished under the prior art. Use of larger cylinders, heavier crossed members, and additional lateral supports is expensive and increases the total load which the cylinders must lift and support. Moreover, the increased stresses and torsional loads on the crossed members and pivot points of the scissors connectors increases the possibility of mechanical failure. Furthermore, positioning the lifting means on support bars at a substantial lateral distance from the crossed members exerts undesirable torques upon the crossed members at their connections to the lifting means.

SUMMARY OF THE INVENTION

The present invention relates to an adjustable scaffold for efficiently and safely lifting heavy loads with a minimum of stress on the supporting members of the scaffold, while providing increased load capacity and stability. The scaffold can be raised and lowered to a range of heights and provides an improved scaffold structure at each of those levels. Both personnel and equipment can be placed on the platform.

According to the present invention, the adjustable scaffold is constructed from a platform supported from a base by at least two sets of scissors connectors between the platform and the base, and a lifting means for adjusting the platform between stored and elevated positions. The lifting means, typically hydraulic cylinders with lever brackets and support brackets pivotally attached thereto, is positioned between sets of scissors connectors, rather than within them. In other words each cylinder is attached to crossed members from different sets of scissors connectors. The lifting means further is operated at approximately the same level of the scissors connectors structure, on both sides of the plane defined by the points comprising the central pivot points of the crossed members. Each set of scissors connectors is comprised of two outer scissors members and only one inner scissors member. The inner scissors member is correspondingly wider than in the prior art and, therefore, eliminates the need for the separate inner scissors members of the prior art.

Accordingly, it is an object of the present invention to provide an improved adjustable scaffold which is simple in construction, yet sturdy and safe, and capable of lifting substantial loads of personnel and equipment.

Another object of the present invention is to provide an improved adjustable scaffold with a significant increase in strength and support capabilities, and which is constructed from a minimum of additional material, thereby adding less additional weight and improving the efficiency of the scaffold.

A further object is to provide an improved adjustable scaffold including a lifting means which is positioned so as to equalize the stress upon supporting members of scissors connectors, thereby minimizing any undue stress placed upon the members.

A still further object is to provide an improved adjustable scaffold having crossed supporting members so constructed as to minimize the amount of torque generated within the scaffold during its operation between stored and elevated positions.

These and other objects, features and advantages of the present invention will be apparent from the following description, claims, and accompanying drawings.

BRIEF DESCRIPTION OF THE DRAWINGS

The apparatus of this invention will be better understood by reference to the accompanying drawings in which.

DESCRIPTION OF THE PREFERRED EMBODIMENT

Figure 1:
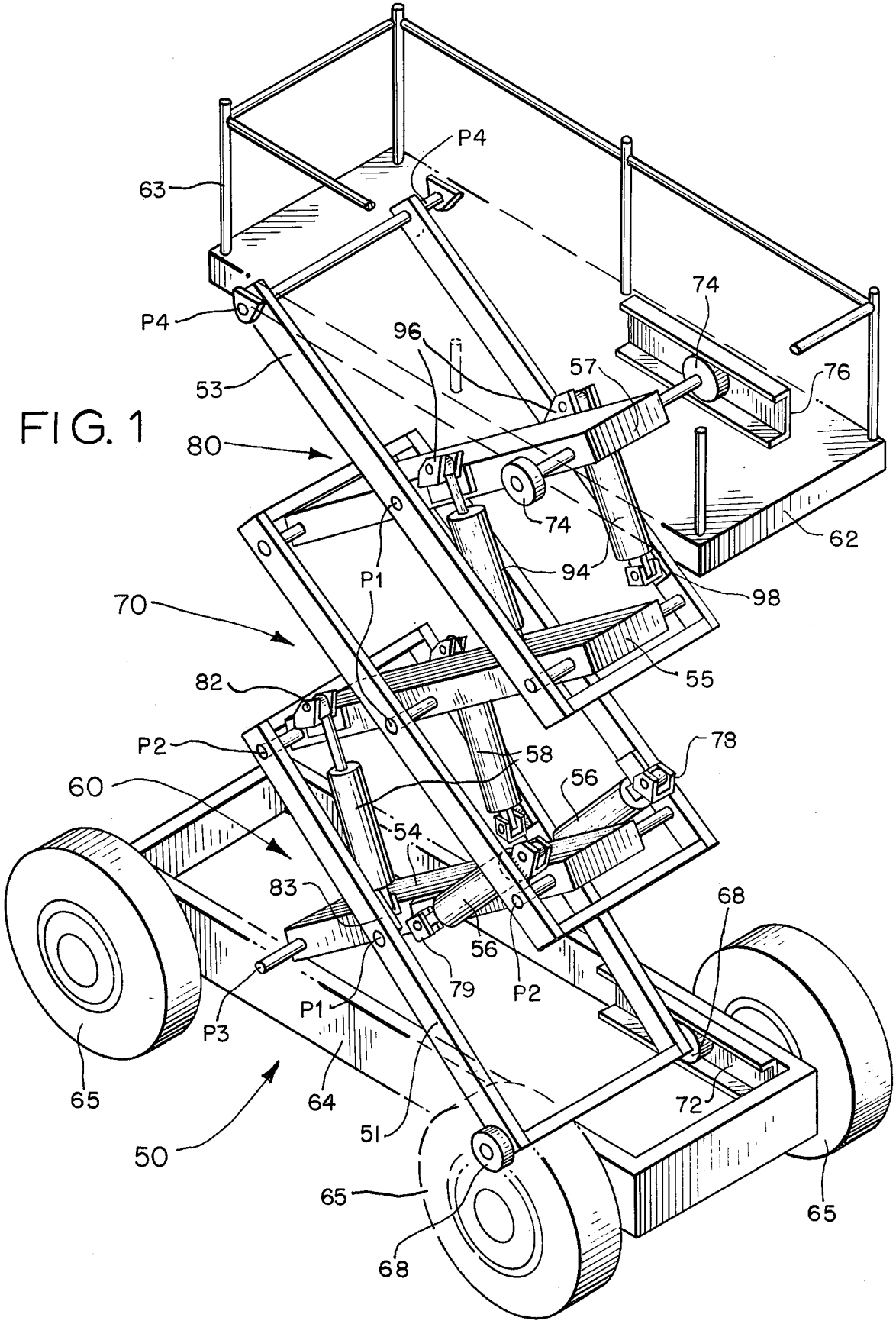
FIG. 1 is a perspective view of an adjustable scaffold embodiment of the present invention, illustrating scissors connectors in a partially extended position.
Figure 2:
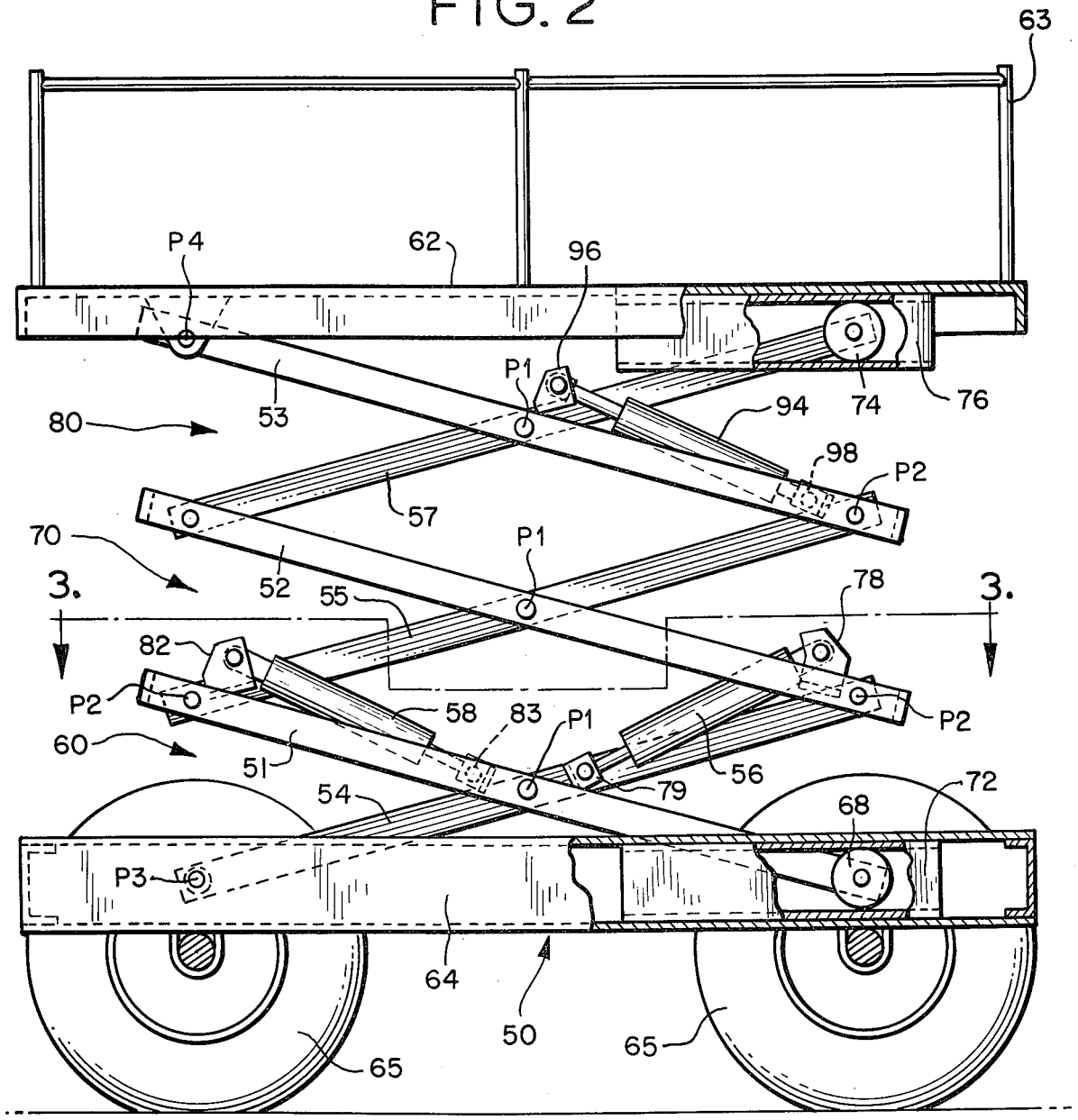
FIG. 2 is a side-elevational view of the adjustable scaffold of FIG. 1 illustrating the positioning of hydraulic cylinders.

Referring now to FIG. 1 and FIG. 2 there is illustrated an adjustable scaffold embodiment of the present invention, indicated generally by reference numeral 50. The adjustable scaffold 50 includes a platform 62 supported from a base 64 by scissors connectors 60, 70, and 80. The base 64 is provided with wheels 65 so that the platform 62 can be moved to and within predetermined work areas. The base 64 alternatively can be self-propelled by the addition of a suitable motor (not shown) and steering mechanism (not shown).

The platform 62 can be adjusted between stored and elevated positions by pivotally joined scissors connectors 60, 70 and 80. A guard rail 63 is provided around the platform 62 to prevent workmen and equipment from accidentally falling from the platform 62. The platform 62 can be provided with controls (not shown) so that the operation of the scissors connectors between stored and elevated positions can be accomplished by personnel while remaining on the platform 62. Additionally, controls for the steering mechanism (not shown) can be included on the platform 62 so that a self-propelling apparatus (not shown) of the adjustable scaffold 50 can be operated from the platform 62.

The scissors connectors 60, 70 and 80 are pivotally joined to each other in a "lazy tong" fashion at connecting pivot points P2 and can be adjusted between closed and open positions by hydraulic cylinders 56, 58, and 94. The fluid which drives the pistons of the hydraulic cylinders is circulated through the cylinders by a hydraulic pump (not shown) located in the base 64. The hydraulic cylinders 56, 58 and 94 and scissors connectors 60, 70, and 80 cooperate to raise and lower the platform 62 to a plurality of positions between stored and fully elevated.

Each of the sets of scissors connectors 60, 70 and 80 comprises two outer members pivotally joined to a single inner member. The first set of scissors connectors 60 comprises first inner member 54 and first outer members 51 pivotally attached at central pivot point P1. The bottom end of first inner member 54 is pivotally attached to the base 64 at bottom stationary pivot points P3. The bottom ends of first outer members 51 are provided with first rollers 68 which rotatably engage the first channels 72 to move the bottom ends of first outer members 51 along a horizontal path during the opening and closing operation of the scissors connectors 60, 70 and 80.

The second set of scissors connectors 70 comprises second inner member 55 and second outer members 52 pivotally attached at central pivot point P1. Both ends of the second inner member 55 and both ends of each of the second outer members 52 are pivotally connected to adjacent first scissors connectors 60 and third scissors connectors 80 at connecting pivot points P2.

The third set of scissors connectors 80 comprises third inner member 57 and third outer members 53 pivotally attached at central pivot point P1. The top ends of the third outer members 53 are pivotally attached to the platform 62 at top stationary pivot points P4. The top end of the third inner member 57 is provided with second rollers 74 which rotatably engage the second channels 76 to move the top end of the third inner member 57 along a horizontal path during the opening and closing operation of the scissors connectors 60, 70 and 80.

The hydraulic cylinders 56, 58 and 94 are used to open and close the scissors connectors 60, 70 and 80, thereby moving the platform 62 to a number of positions between stored and fully elevated. The first pair of hydraulic cylinders 56 and the second pair of hydraulic cylinders 58 are attached between, rather than within sets of scissors connectors. The third pair of hydraulic cylinders 94 are attached within the third set of scissors connectors 80. In order to enable the scissors connectors to lift a load of approximately 3500 pounds to a height of 24 feet, each of the first and second hydraulic cylinders 56 and 58 preferably has a four-inch inner diameter and a sixteen-inch stroke. Additionally, each of the third hydraulic cylinders 94 preferably has a four-inch inner diameter and a twelve-inch stroke.

The first hydraulic cylinders 56 and the second hydraulic cylinders 58 are connected between the first set of scissors connectors 60 and the second set of scissors connectors 70. The bottom ends of the first hydraulic cylinders 56 are pivotally attached to the first support brackets 79 which are secured to the first inner member 54 at a position closer to the middle than to an end of the first inner member 54. Additionally, the top ends of the first hydraulic cylinders 56 are pivotally attached to the first lever brackets 78 which are secured to the second outer members 52 at a position closer to an end than to the middle of the second outer members 52. In this way, the lifting forces provided by the extension of the first hydraulic cylinders 56 are applied between the first set of scissors connectors 60 and the second set of scissors connectors 70.

The lifting forces provided by the extension of the second hydraulic cylinders 58 are also applied between the first set of scissors connectors 60 and the second set of scissors connectors 70. To accomplish this result, the lower ends of the second hydraulic cylinders 58 are pivotally attached to the second support brackets 83 which are secured to the first outer members 51 at a position closer to the middle than to an end of the first outer member 51. The top ends of the second hydraulic cylinders 58 are pivotally attached to the second lever brackets 82 which are secured to the second inner member 55 at a position closer to an end than to the middle of the second inner member 55.

The third set of hydraulic cylinders 94 provides additional lifting force at a position which is closer to a load on the platform 62 than the first and second hydraulic cylinders 56 and 58 are. The third hydraulic cylinders 94 operate within the third set of scissors connectors 80. The lower ends of the third hydraulic cylinders 94 are pivotally attached to the third support brackets 98 which are secured to the third outer members 53 at a position closer to the middle than to an end of the third outer members 53. The top ends of the third hydraulic cylinders 94 are pivotally attached to the third lever brackets 96 which are secured to the third inner member 57 at a position closer to the middle than to an end of the third inner member 57.

During the opening and closing of the scissors connectors 60, 70 and 80, the hydraulic cylinders 56, 58 and 94 operate in unison from a single source of hydraulic fluid (not shown) simultaneously pumped into tubes (not shown) which follow the paths of the scissors connectors to the hydraulic cylinders. In the event of a partial mechanical failure of any one of the cylinders, producing a malfunction such as leakage of hydraulic fluid, the hydraulic cylinders controllably retract because the hydraulic cylinders are equipped with maximum pressure exit valves (not shown).

All the hydraulic cylinders are positioned laterally between the scissors connectors so as to minimize the torque generated within the scaffold during its operation between stored and elevated positions. The spacing of the hydraulic cylinders, supporting members, and interconnecting brackets with respect to each other is more clearly illustrated by reference to FIG. 3. The first hydraulic cylinders 56 are laterally spaced intermediate and substantially equidistant from both the first inner member 54 and second outer members 52. The inner clearance plates 84 secured to the first inner member 54 provide clearance for pivotal attachment of the first hydraulic cylinders 56 to the first support brackets 79 and thereby to the first inner member 54.

Likewise, the second hydraulic cylinders 58 are laterally spaced intermediate and substantially equidistant from both the first outer members 51 and the second inner member 55. The outer clearance plates 86 secured to the first outer members 51 provide clearance for pivotal attachment of the second hydraulic cylinders 58 to the second support brackets 83 and thereby to the first outer members 51.

Figure 3:
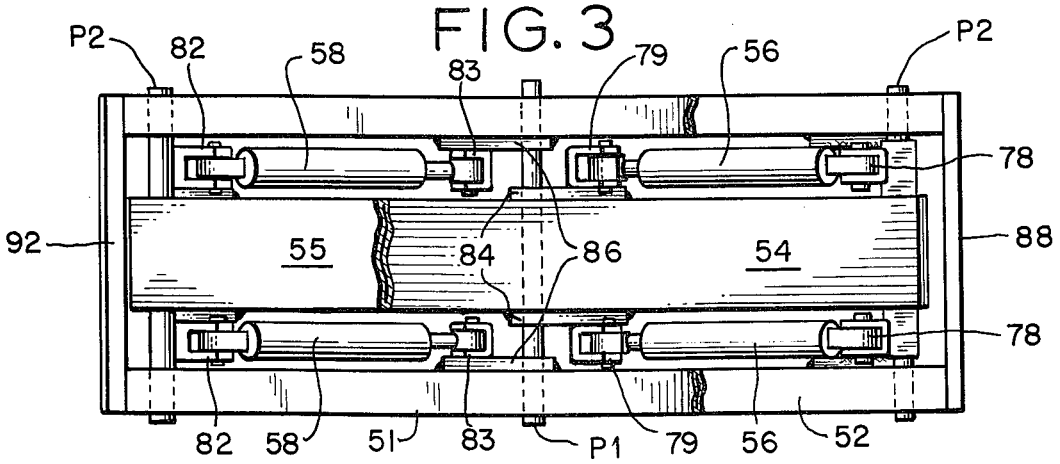
FIG. 3 is a horizontal sectional view of the support structure of the adjustable scaffold of FIG. 2 as seen from a line taken across 3—3 and further illustrating a single inner scissors member and the positioning of hydraulic cylinders.

Although this arrangement of the hydraulic cylinders and inner and outer members of the scissors connectors provides significant support and rigidity for loads in excess of 3000 pounds, additional stability and support against torsional stress is achieved by means of cross beams at the ends of the outer members 51, 52 and 53. The cross beams also reduce the stress on the support members at the connecting pivot points P2. As shown in FIG. 3, first upper cross beam 92 is secured across the ends of first outer members 51 and second lower cross beam 88 is secured across the ends of second outer members 52.

Of course, various other changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

1. An adjustable scaffold comprising:

a base;

a platform connected to said base; and means for raising and lowering said platform above said base, comprising first and second scissors connectors between said platform and said base, each of said scissors connectors having an inner member pivotally connected to two outer members, said first and second scissors connectors being pivotally joined to each other at ends of their members, and a pair of hydraulic cylinders, each of said cylinders having a bottom end pivotally attached to the inner member of said first scissors connector at a position closer to the middle than to an end of said inner member, and a pair of lever brackets, each of said lever brackets being pivotally attached to a top end of each of said pair of hydraulic cylinders, each of said lever brackets further being secured to an outer member of said second scissors connector at a position closer to an end than to the middle of the outer member.

2. The adjustable scaffold of claim 1 wherein said hydraulic cylinders are positioned laterally intermediate said inner and outer members.

3. An adjustable scaffold comprising:

a base;

a platform connected to said base; and means for raising and lowering said platform above said base, comprising first and second scissors connectors between said platform and said base, each of said scissors connectors having an inner member pivotally connected to two outer members, said first and second scissors connectors being pivotally joined to each other at ends of their members, and a pair of hydraulic cylinders, each of said hydraulic cylinders having a top end pivotally attached to the inner member of said second scissors connector at a position closer to an end than to the middle of said inner member, and a pair of lever brackets, each of said lever brackets being pivotally attached to a bottom end of each of said pair of hydraulic cylinders, each of said lever brackets further being secured to the outer members of said first scissors connector at a position closer to the middle than to an end of the outer members.

4. The adjustable scaffold of claim 3 wherein said hydraulic cylinders are positioned laterally intermediate said inner and outer members.

5. An adjustable scaffold comprising:

a base;

a platform;

first and second scissors connectors coupled between said platform and said base, each of said scissors connectors having a pair of outer members pivotally connected to an inner member;

means for pivotally connecting one end of the outer members of said first scissors connector to one end of the inner member of said second scissors member;

means for pivotally connecting one end of the inner member of said first scissors connector to one end of the outer members of said second scissors connector;

a first pair of hydraulic cylinders having respective bottom ends pivotally attached to the inner member of said first scissors connector at positions closer to the middle than to an end of said inner member, and having respective upper ends pivotally attached to the outer members of said second scissors connector at positions closer to an end than to the middle of said outer members; and a second pair of hydraulic cylinders having respective bottom ends pivotally attached to the outer members of said first scissors connector at positions closer to the middle than to the ends of said outer members, and having respective upper ends pivotally attached to the inner member of said second scissors connector at a position closer to the end than to the middle of said inner member.

6. The adjustable scaffold of claim 5 wherein said hydraulic cylinders are positioned laterally intermediate said inner and outer members.

* * * * *